United States Patent [19]

Gallo et al.

[11] 3,939,386

[45] Feb. 17, 1976

[54] TECHNIQUE FOR CHARGING DIELECTRIC SURFACES TO HIGH VOLTAGE

[75] Inventors: Charles F. Gallo; Thomas J. Hammond, both of Penfield, N.Y.

[73] Assignee: Xerox Corporation, Stamford, Conn.

[22] Filed: Jan. 30, 1975

[21] Appl. No.: 545,638

[52] U.S. Cl. ..... 317/262 A; 250/325; 250/326

[51] Int. Cl.[2] ..... H01T 19/00

[58] Field of Search ..... 317/262 A, 3; 250/324–326

[56] References Cited

UNITED STATES PATENTS

| | | | |
|---|---|---|---|
| 2,314,940 | 3/1943 | Hewitt | 317/2 R |
| 3,678,350 | 7/1972 | Matsumoto et al. | 317/262 A |

*Primary Examiner*—J. D. Miller
*Assistant Examiner*—Harry E. Moose, Jr.
*Attorney, Agent, or Firm*—Robert J. Bird

[57] ABSTRACT

A technique for charging a dielectric surface by corona discharge is described in which the voltage applied to a stationary corona wire is steadily increased over an initial time period to cause the gradual increase in voltage level on the dielectric surface over the same time period. The voltage on the stationary dielectric surface increases with the wire voltage. The potential difference between wire and plate is kept below the sparking voltage, but above the corona current threshold voltage.

After the initial phase, the dielectric surface is moved relative to the corona wire (e.g. a rotating xerographic drum). The corona wire can now be held at its high voltage without sparking between the wire and the dielectric surface.

4 Claims, 5 Drawing Figures

PRIOR ART

TECHNIQUE FOR CHARGING DIELECTRIC SURFACES TO HIGH VOLTAGE

BACKGROUND OF THE INVENTION

Reference is hereby made to our copending application Ser. No. 422,050, filed Dec. 5, 1973, now U.S. Pat. No. 3,873,895.

This invention relates generally to the field of electrostatics and particularly to a technique for charging dielectric surfaces to high voltage levels.

One application for charging devices is in xerography in which a photoconductive dielectric surface is charged with positive or negative charges, then exposed to an object whereby the imagewise discharging of the photoconductor leaves a latent electrostatic image of the original object on the surface.

One present technique for applying electrostatic charge to a dielectric surface is by means of a corona discharge. In such an arrangement, a corona generating device is placed near the dielectric surface to be charged and ions generated around the corona wire flow to the dielectric surface because of potential difference between the wire and the surface. Further details regarding present corona charging devices and their relation to xerography are available in "Xerography and Related Processes" by Dessauer and Clark, published in 1965 by The Focal Press. The relevant disclosures in this book are incorporated in this specification by reference.

In corona charging devices typical of the prior art (see FIG. 1), a fixed voltage level is applied to a corona wire and charge is deposited and accumulated on the nearby dielectric surface or plate. The wire voltage must be high enough that the electric field surrounding the wire ionizes the air in the immediate vicinity. This minimum voltage, which is required to initiate a corona current, is called the threshold voltage ($V_O$). Another factor is that the corona current is dependent upon the voltage difference or potential difference between wire and plate. Thus, if a corona wire is used to charge a dielectric plate, the current is determined by the voltage difference between the wire and the plate. If a voltage $V_w$ is applied to the wire, an initial current $I_w$ is drawn. This current will charge the dielectric plate and thereby reduce the potential difference between the wire and the plate. The corona current then decreases along a current-voltage curve until the voltage difference between the wire and the plate surface is reduced to the threshold voltage $V_O$ as a limit. In other words, the corona current asymptotically approaches zero.

The voltage on the plate, $V_p$, increases with time during the charging and asymptotically approaches the value of the wire voltage less the threshold voltage. That is, the limit $V_p = V_w - V_O$.

For wire-to-plane coronas, the maximum voltage which corona is finally capable of applying to dielectric plates ($V_p$ max) is determined by the maximum voltage which can be applied to the wire, which is essentially the sparking or arcing voltage $V_s$. Thus, by extending the foregoing equation to its limit, $V_p \max = V_s - V_O$.

By means of the present invention, the voltage limits inherent in such prior art charging methods are removed.

DRAWINGS

DESCRIPTION

Figure 1:
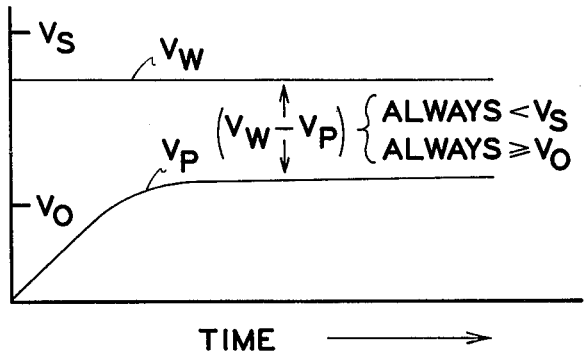
FIG. 1 is a curve of wire and plate voltages plotted against time in a typical prior art charging process, in which the wire-to-plate current is dominant.

Referring now to FIG. 1, a typical prior art charging process is represented including a constant corona wire voltage and an increasing plate voltage asymptotically approaching the value of $V_w$ - $V_O$ as a limit. Two conditions are observed. First the potential difference between wire and plate must be less than the sparking voltage $V_s$ to avoid breakdown. Second, the potential difference between wire and plate must be greater than the threshold voltage $V_O$ to maintain current flow. FIG. 1 represents graphically how these conditions are met. The maximum plate voltage $V_p$ max obtainable with this conventional scheme is $V_s$ - $V_O$.

Figure 2:
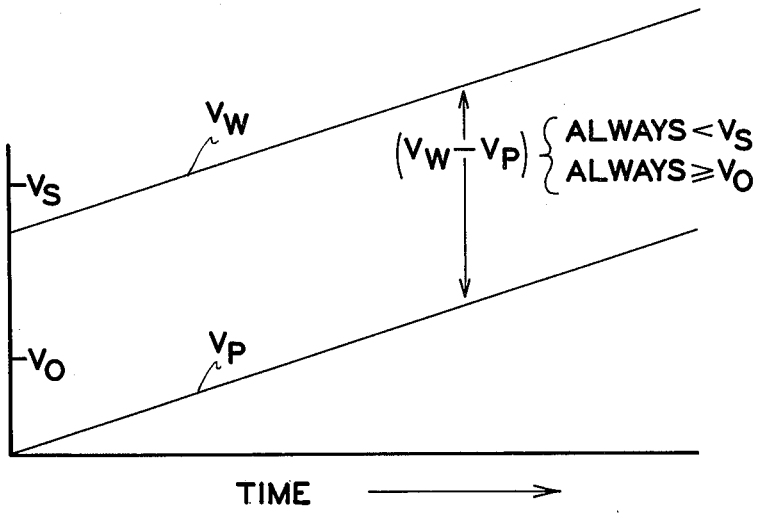
FIG. 2 is a curve similar to that shown in FIG. 1 showing the initial phase of the process as practiced in the present invention.

Referring now to FIG. 2, a charging process used in this invention is represented in which the wire voltage $V_w$ is increased steadily during the charging process and concurrently with this increase, the plate voltage $V_p$ similarly increases. The necessary conditions stated above are met. That is, at all times the potential difference between wire and plate is less than the sparking voltage Vs but greater than the threshold voltage $V_O$ necessary to maintain current flow. Simply by staying within these limits, the wire voltage $V_w$ can be increased to bring the plate voltage $V_p$ to any desired level, subject only to other limitations, such as breakdown of the dielectric plate, which are not material to this invention. This scheme circumvents the usual limitations imposed by the arcing voltage. It should be noted that this process is primarily relevant to a stationary wire over a stationary dielectric substrate.

Figure 3:
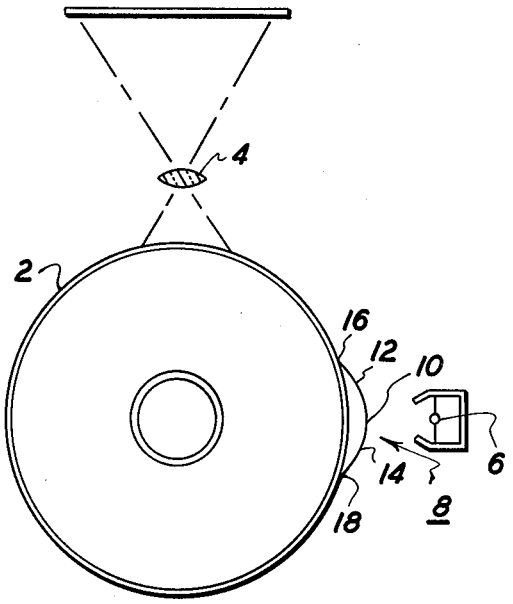
FIG. 3 is a schematic diagram of a stationary xerographic drum and corona charging system.

Referring now to FIG. 3, the charging concept described in connection with FIG. 2, is shown in the environment of a xerographic apparatus. In this schematic, a xerographic drum 2 is rotatably mounted relative to an exposure station 4 and a charging corona wire 6. The drum 2 is initially in a discharged or uncharged conditions. While remaining stationary, the drum is charged by means of a corona wire 6 to a desired level following the process described in connection with FIG. 2. A charge level is thus imparted to the drum 2 in the area directly under the corona wire 6 and in adjacent areas on either side. The distribution of this charge level is represented by a distribution curve 8 which is illustrated as superimposed on the surface of drum 2. The distribution curve 8 shows a maximum charge level 10 directly under the corona wire 6, and lower charge levels 12 and 14 on either side of the maximum, tapering away from the maximum and approaching a zero charge level at some relatively remote location from the wire 6, exemplified by 16 and 18 in FIG. 3. When this condition is reached, the drum 2 can be set in motion as described next.

Figure 4:
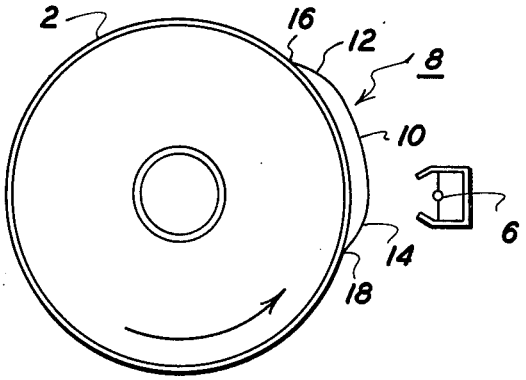
FIG. 4 is a schematic diagram similar to FIG. 3 showing the drum in motion and representing the pattern of charge accumulation thereon.

Referring now to FIG. 4, the drum 2 is shown without the exposure station for simplicity, and is rotating counterclockwise as indicated by the arrow. Referring to the distribution curve 8, it will be apparent that the area 10 of initial maximum charge has rotated away from the corona wire 6 and the area 10 of maximum charge has now been extended around a substantial arc of the drum connecting the areas of lesser charge 12 and 14. After the initial maximum charge level 10 (FIG. 3) has been deposited on the drum, and the drum is set in motion (FIG. 4), there is a continuous advance of the drum, with its areas of zero charge 18 and lesser charge 14, under the corona wire 6 which imparts to the drum the maximum charge level 10 continuously to that area of the drum directly beneath the wire 6. In other words, there is a continuous process of progressively increasing the charge level from the zero charge represented at 18 to the maximum charge represented at 10 on the distribution curve. By this progressively building up the drum charge level, the two required conditions can be observed regardless of the voltage level of the corona wire 6. The potential difference between wire and plate (at the location directly beneath the wire) is maintained at less than the sparking voltage $V_s$ to avoid breakdown, and at greater than the threshold voltage $V_0$ to maintain current flow.

Figure 5:
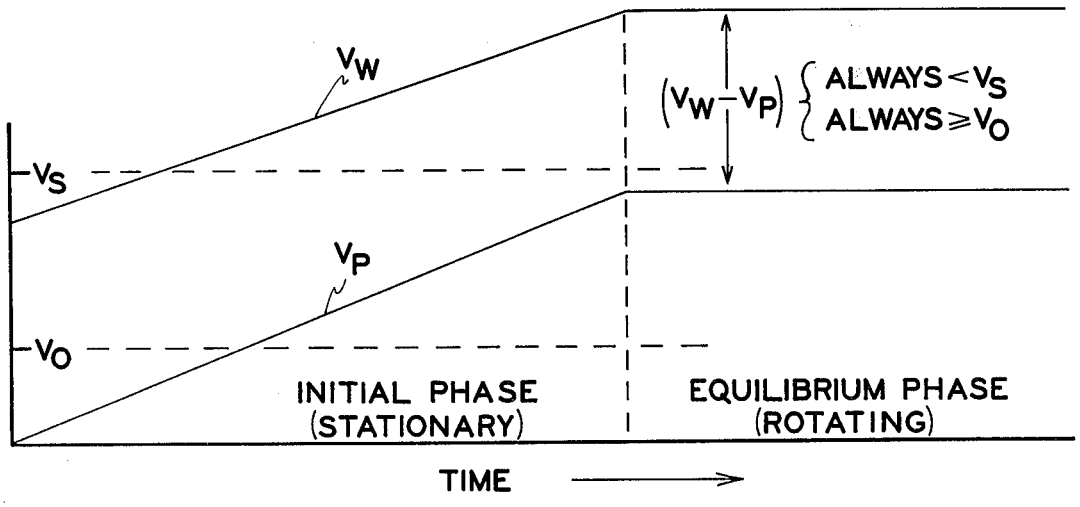
FIG. 5 is a curve similar to that in FIG. 2 but showing both the initial phase and the equilibrium phase of the process of this invention.

FIG. 5 represents graphically how the required conditions are met, both in the initial phase when the drum is stationary and in the equilibrium phase when the drum is rotating. By comparing FIG. 5 with FIG. 2, it will be observed that the initial (stationary) phase of the present technique is the same as that represented in FIG. 2 and disclosed in our application Ser. No. 422,050. The equilibrium phase however has a different basis of operation. In this phase, the gradual build-up of charge is accomplished by bringing the area 18 to be charged gradually into closer proximity to the corona wire 6 so that the charge deposited on the area 18 develops as represented on the charge distribution curve to its maximum 10 when that area is directly under the corona wire.

The time required for the initial phase depends on how much greater the $V_w$ is than the $V_s$, the available current, the width of the corona current distribution, the drum speed, drum radius, and wire-to-drum spacing.

The foregoing description of the method of this invention is given by way of illustration and not of limitation. The curves and the schematics are representative only. The concept and scope of the invention are limited only by the following claims and equivalents thereof which may occur to others skilled in the art.

What is claimed is:

1. A method of applying electrostatic charge to a dielectric surface by means of a corona electrode operatively disposed relative to said dielectric surface, including the steps of:

a. applying a voltage to said corona electrode at a level relative to that of said dielectric surface above the threshold level required to ionize the surrounding atmosphere and generate corona current, and below the sparking level at which sparking occurs, so that corona current flows to said dielectric surface, b. increasing the voltage of said corona electrode in relation to the increase of voltage of said dielectric surface according to the condition that the potential difference between said corona electrode and said dielectric surface remains between said sparking level and said threshold level, while the voltage of said corona electrode is increased above the sparking level, and c. initiating relative movement between said dielectric surface and said corona electrode so as to continually bring parts of said dielectric surface from remote to proximate position relative to said corona electrode, so that any part of said dielectric surface is introduced to the distribution field of said corona current progressively, whereby the voltage of said dielectric surface may be increased above the sparking level.

2. A method of applying electrostatic charge to a dielectric surface by means of a corona discharge, including the steps of:

a. applying a voltage to a corona electrode operatively disposed relative to said dielectric surface, said voltage being at a level relative to that of said dielectric surface above the threshold level required to ionize the surrounding atmosphere and generate corona current, and below the sparking level at which sparking occurs, so that corona current flows to said dielectric surface, b. increasing the voltage of said corona electrode in relation to the increase of voltage of said dielectric surface according to the condition that the potential difference between said corona electrode and said dielectric surface remains between said sparking level and said threshold level, while the voltage of said corona electrode is increased above the sparking level, and c. moving said dielectric surface relative to said corona electrode so that a given area of said surface passes relative to said electrode from a relatively remote to a relatively proximate position so as to introduce said given area of said surface to the distribution field of said corona current progressively, whereby the voltage applied to said corona electrode and said dielectric surface may be increased above said sparking level.

3. A method of applying electrostatic charge to a dielectric surface by means of a corona electrode operatively disposed relative to said dielectric surface, including the steps of:

a. applying a voltage ($V_w$) to said corona electrode at a level such that the difference in potential between said corona electrode and said dielectric surface is above the threshold level ($V_0$) required to ionize the surrounding atmosphere and generate corona current, and below the sparking level ($V_s$) at which sparking occurs, so that corona current flows to said dielectric surface to accumulate electrostatic charge thereon, b. increasing the voltage ($V_w$) of said corona electrode with reference to the accumulated voltage ($V_p$) of said dielectric surface so that the difference in potential between said corona electrode and said dielectric surface ($v_w$ - $V_p$) is kept above the threshold level ($V_0$) and below the sparking level ($V_s$) while the voltage ($V_w$) of said corona electrode is increased above the sparking level ($V_s$) and whereby the voltage ($V_p$) of said dielectric surface may be increased above the sparking level ($V_s$), c. moving said dielectric surface relative to said corona electrode so that any given area of said surface passes relative to said electrode from a relatively remote to a relatively proximate position so as to introduce said given area of said surface to the distribution field of said corona current progressively, and d. continuing step (c) so as to continually provide such high voltage charge to said moving dielectric surface.

4. A method as defined in claim 3 in which said dielectric surface is a rotatable drum.

* * * * *